US009328986B1

(12) United States Patent
Pennau et al.

(10) Patent No.: US 9,328,986 B1
(45) Date of Patent: May 3, 2016

(54) TURRET ASSEMBLY

(71) Applicant: Oshkosh Corporation, Oshkosh, WI (US)

(72) Inventors: Kevin L. Pennau, Oshkosh, WI (US); Neil E. DeKarske, Oshkosh, WI (US); Colin E. Wheeler, Ripon, WI (US); Dean W. Seefeldt, Malone, WI (US); Andrew P. McClaine, Eldorado, WI (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

(21) Appl. No.: 14/532,679

(22) Filed: Nov. 4, 2014

(51) Int. Cl.
*F41A 23/24* (2006.01)
*F41A 23/34* (2006.01)

(52) U.S. Cl.
CPC ..... *F41A 23/24* (2013.01); *F41A 23/34* (2013.01)

(58) Field of Classification Search
CPC ..... F41A 27/00; F41A 27/02; F41A 27/06; F41A 27/18; F41A 27/20; F41A 27/08; F41A 23/24
USPC ..... 89/37.12; 114/230.12
See application file for complete search history.

(56) References Cited

U.S. PATENT DOCUMENTS 2,175,852 A * 10/1939 Perkins ..... F41A 27/18 89/36.13
2,176,907 A * 10/1939 Knisley ..... F41A 27/08 89/37.16
2,227,726 A * 1/1941 Laddon ..... F41A 23/20 89/37.16
2,258,939 A * 10/1941 Poche ..... F41A 27/18 89/36.13
2,373,127 A 4/1945 Lord
2,389,726 A 11/1945 Goodhue
2,441,874 A * 5/1948 Evans ..... F41A 23/34 89/37.03
3,261,262 A 7/1966 Hilfing et al.
3,333,507 A 8/1967 De Meiss
3,630,585 A * 12/1971 Hall ..... E04H 12/18 384/620
5,359,957 A * 11/1994 Askestad ..... B63B 21/507 114/230.12
5,762,017 A * 6/1998 Groves ..... B63B 21/507 114/230.12
7,021,189 B2 4/2006 Patry et al.
8,215,225 B1 7/2012 Zangrando et al.

(Continued)

FOREIGN PATENT DOCUMENTS

DE 9 77 774 C 1/1970
DE 15 78 337 A1 8/1971
DE 39 28 614 A1 10/1992

(Continued)

OTHER PUBLICATIONS

Plattmounts Product Web Page, retrieved from the internet at: http://www.plattmounts.com/product/fw-655-open-ring-mount on Nov. 4, 2014, 2 pages.

(Continued)

*Primary Examiner* — Reginald Tillman, Jr.
(74) *Attorney, Agent, or Firm* — Foley & Lardner LLP

(57) ABSTRACT

A turret assembly includes a mounting plate and a ring rotatably engaged with the mounting plate. The ring includes a first arm extending radially outward relative to a central axis of the ring. The turret assembly further includes a second arm pivotally coupled to the first arm and a telescoping member. The telescoping member has a first end pivotally coupled to the ring and a second end pivotally coupled to the second arm. The second arm is selectively repositionable between a storage orientation and an operating orientation.

15 Claims, 7 Drawing Sheets

(56) References Cited

U.S. PATENT DOCUMENTS

| | | | | |
|---|---|---|---|---|
| 8,671,864 | B2 * | 3/2014 | Lindblade | B63B 21/507 114/230.12 |
| 2003/0205188 | A1 * | 11/2003 | McCollum | B63B 9/00 114/230.12 |

FOREIGN PATENT DOCUMENTS

| | | | |
|---|---|---|---|
| DE | 1020110 08 698 | A1 | 7/2012 |
| EP | 0 125 183 | A2 | 11/1984 |
| EP | 0 141 018 | A2 | 5/1985 |
| EP | 0 899 533 | A2 | 3/1999 |
| EP | 1 318 373 | A1 | 6/2003 |
| EP | 1 333 239 | A2 | 8/2003 |
| EP | 1 333 240 | A2 | 8/2003 |
| EP | 1 557 633 | A1 | 7/2005 |
| EP | 2 071 268 | A1 | 6/2009 |
| FR | 2654819 | A1 | 5/1991 |
| GB | 0 579 674 | A | 8/1946 |

OTHER PUBLICATIONS

Product Brochure for Platt FW655 Open Ring Mount, retrieved from the internet at: http://www.plattmounts.com/assets/files/FW655-Open-Ring-Mount-brochure---Feb-2014.pdf on Jul. 29, 2014, 2 pages.

* cited by examiner

TURRET ASSEMBLY

BACKGROUND

A turret assembly may be utilized on a wheeled or a tracked military vehicle and may be configured to provide an ingress or egress for a user from the roof of the vehicle. Traditional turret assemblies include a weapons mount or adapter for mounting various military weapons, such as guns or other similar weapons. The weapons mount may be in a fixed position on the turret assembly and allows a user to access the weapon through an opening in the roof of the vehicle. Traditional turret assemblies are also configured to rotate relative to the vehicle on ball bearings such that a user can operate a mounted weapon in 360 degrees of azimuth. Such turret assemblies often have a fixed height.

Vehicles including traditional turret assemblies can be difficult to transport due to the overall height of the assembly on the vehicle. Thus, the weapons mount may be fastened to the turret assembly after the vehicle has been transported to a location where the vehicle will be deployed, which can be time consuming and present various theater-related challenges. Furthermore, the fixed weapons mount may be configured to accommodate only users having similar biological traits, such as similar heights and weights, due to the fixed position of the weapons mount relative to the opening of the turret assembly.

Many turret assemblies include ball bearings for rotating the turret assembly relative to the vehicle. Such ball bearing assemblies generally require regular maintenance, such as lubrication, repair, or replacement. Moreover, the ball bearings may be prone to contamination in harsh environments, such as in the desert, and can result in rough and unpredictable rotation of the turret assembly.

SUMMARY

One embodiment of the present invention relates to a turret assembly. The turret assembly includes a mounting plate and a ring rotatably engaged with the mounting plate. The ring includes a first arm extending radially outward relative to a central axis of the ring. The turret assembly further includes a telescoping member and a second arm pivotally coupled to the first arm. The telescoping member has a first end pivotally coupled to the ring and a second end pivotally coupled to the second arm. The second arm is selectively repositionable between a storage orientation and an operating orientation.

Another embodiment of the present invention relates to a turret assembly. The turret assembly includes a mounting plate, a plurality of vertically disposed bearing wheels coupled to the mounting plate, and a plurality of horizontally disposed bearing wheels coupled to the mounting plate. The turret assembly further includes a ring rotatably engaged with the mounting plate via the plurality of vertically disposed bearing wheels and the plurality of horizontally disposed bearing wheels.

Yet another embodiment of the present invention relates to a vehicle that includes a chassis, a body coupled to the chassis and including a roof defining an opening disposed therein, and a turret assembly coupled to the roof and at least partially disposed in the opening. The turret assembly includes a mounting plate having a fixed orientation relative to the roof, a plurality of vertically disposed bearing wheels coupled to the mounting plate, a plurality of horizontally disposed bearing wheels coupled to the mounting plate, and a ring rotatably engaged with the mounting plate via the plurality of vertically disposed bearing wheels and the plurality of horizontally disposed bearing wheels, the ring including a first arm extending outward from a peripheral edge of the ring. A second arm is pivotally coupled to the first arm. The turret assembly further includes a telescoping member having a first end pivotally coupled to the ring and the second end pivotally coupled to the second arm. The second arm is selectively repositionable to reconfigure the turret assembly between a storage orientation and an operating orientation.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
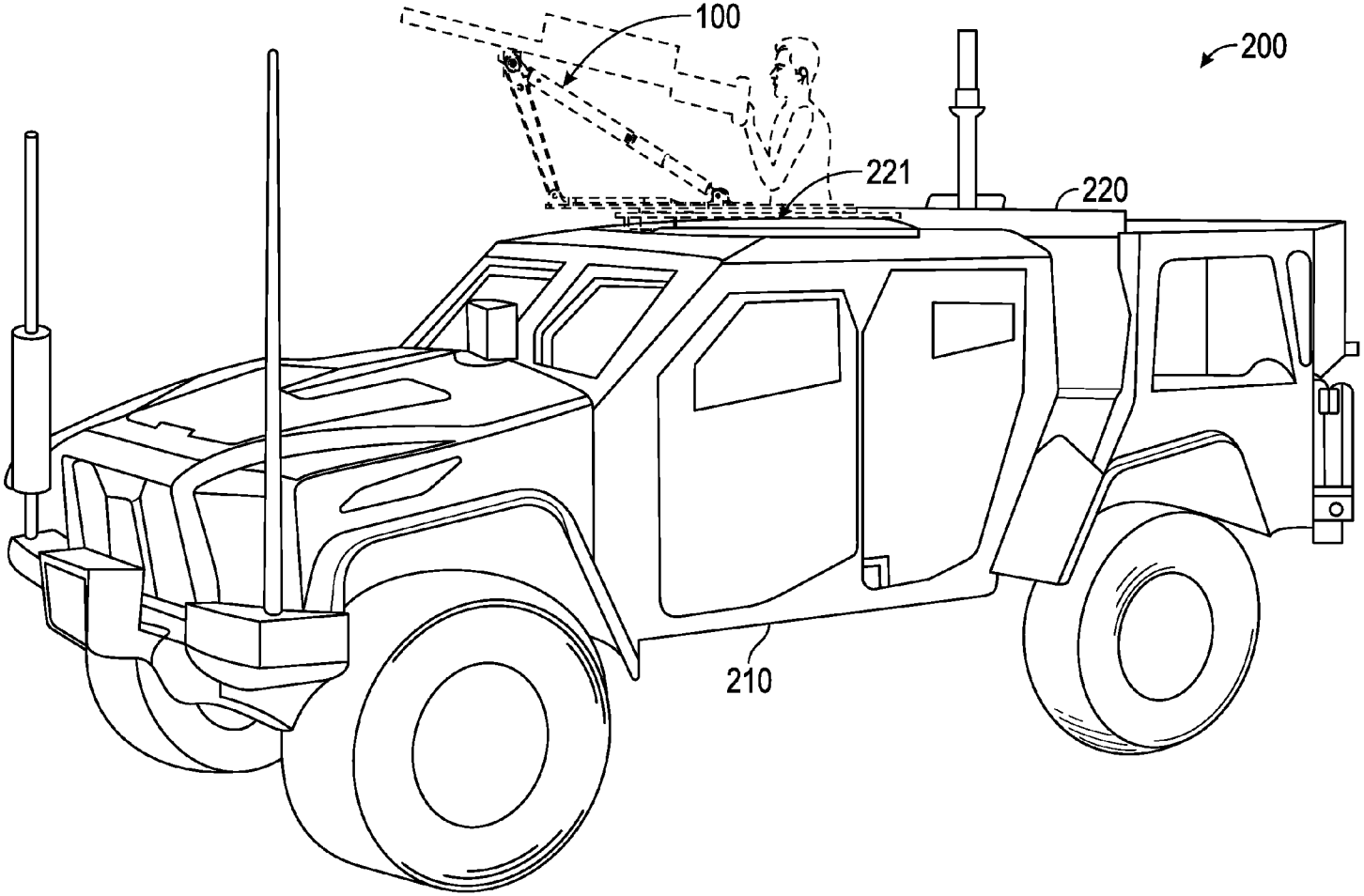
FIG. 1 is a perspective view of a vehicle including a turret assembly, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a turret assembly includes an adjustable weapons mount that can be selectively pivoted (e.g., articulated, adjusted, etc.) between a storage position and a plurality of operating positions. The turret assembly is configured to be mounted to a vehicle, such as a wheeled or a tracked vehicle. The vehicle may be a military vehicle, a fire apparatus, or still another vehicle. In one embodiment, the turret assembly includes a first arm extending from a turret ring and a second arm pivotally coupled to the first arm. The second arm includes a free end that is configured to receive a weapon (e.g., a weapon adapter or mount, etc.). The free end of the second arm is pivotally coupled to the turret ring and engages a pair of telescoping members (e.g., telescoping struts, etc.). The second arm is configured to be selectively pivoted and may be locked at a position relative to the turret ring to thereby adjust a relative position of the weapon mount or adapter. In this manner, the turret assembly may be easily adjusted to accommodate various users having different biological traits, such as height and weight, and to be easily transported on a vehicle without the need for tools or disassembly of the turret assembly from the vehicle.

The turret assembly may include a turret ring rotatably engaged with a mounting plate via a plurality of vertically and horizontally disposed bearing wheels. The plurality of vertically and horizontally disposed bearing wheels are coupled to the mounting plate with a plurality of mounting blocks. The plurality of vertically and horizontally disposed bearing wheels are each positioned at least partially below the mounting plate, thereby reducing the overall height of the turret assembly. The plurality of vertically disposed bearing wheels are each oriented in a substantially upright (e.g., vertical, etc.) position relative to the turret ring such that a lower surface of the ring engages the vertically disposed bearing wheels. The plurality of horizontally disposed bearing wheels are each positioned substantially horizontally relative to the turret ring such that a side surface or channel of the turret ring engages the horizontally disposed bearing wheels. In this manner, the turret ring can freely rotate relative to the mounting plate about the vertically and horizontally disposed bearing wheels. The turret ring may have an open underside such that the plurality of vertically and horizontally disposed bearing wheels are less prone to contamination, thereby enabling the turret ring to be predictably and reliably rotated in harsh environments.

Referring to the exemplary embodiment shown in FIG. 1, a turret assembly 100 is coupled to an upper surface of a vehicle 200. The upper surface may be a roof of the vehicle that defines an opening to provide access to the cabin area of the vehicle and facilitate use of the turret assembly 100. The vehicle may be a wheeled or a tracked vehicle, such as a military transport vehicle, a tank, or a similar vehicle. By way of example, the vehicle 200 shown in FIG. 1 is a joint light tactical vehicle (JLTV). As shown in FIG. 1, the vehicle 200 includes a chassis 210 and a body 220. Body 220 includes a roof having an opening 201 disposed therein that is configured to receive the turret assembly 100.

Figure 2A:
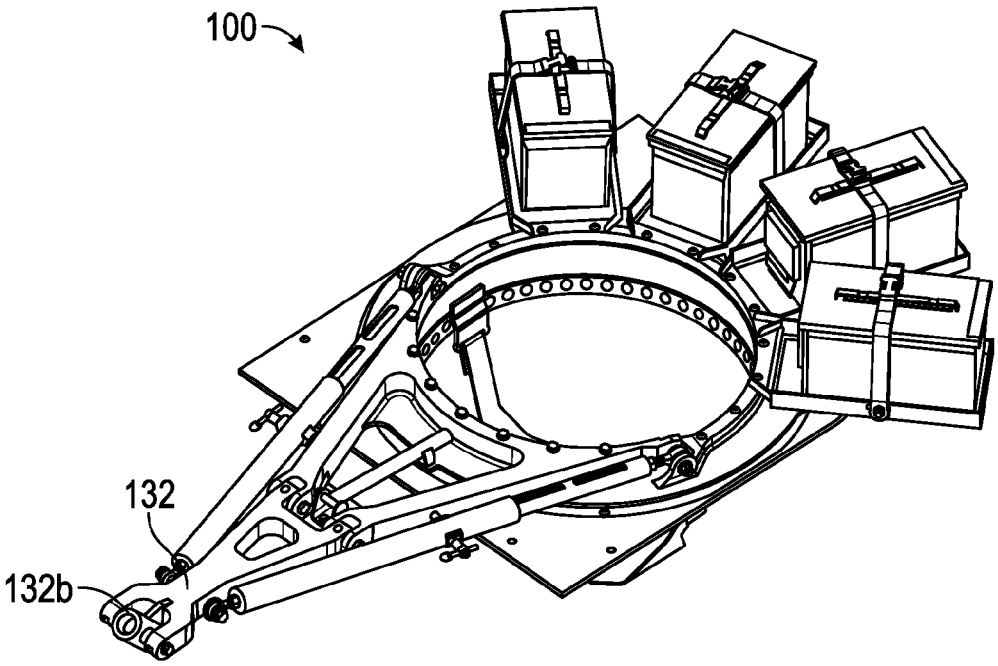
FIGS. 2A-2B illustrate a turret assembly in a storage position and an operating position, according to an exemplary embodiment.
Figure 2B:
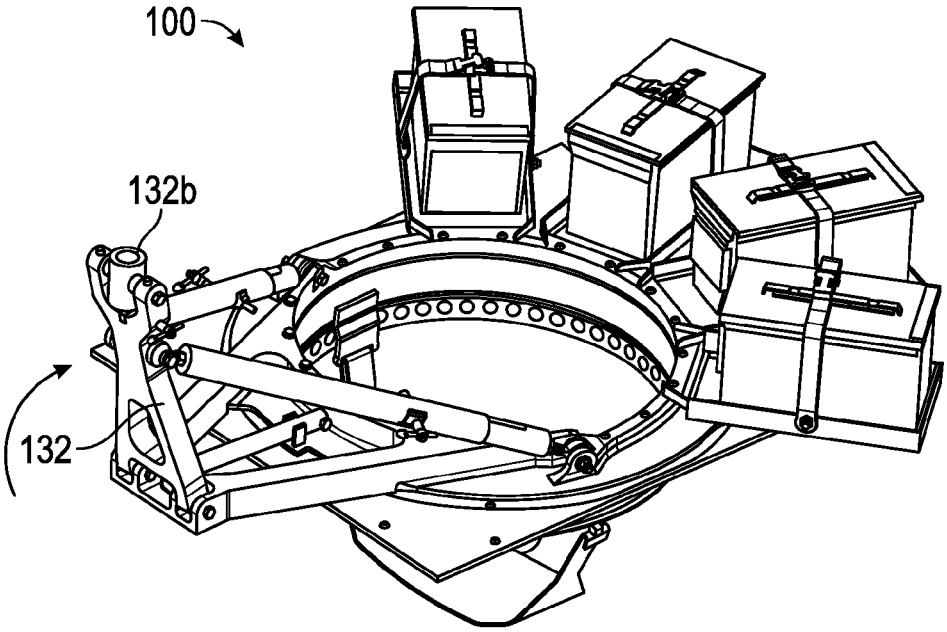
Figure 3:
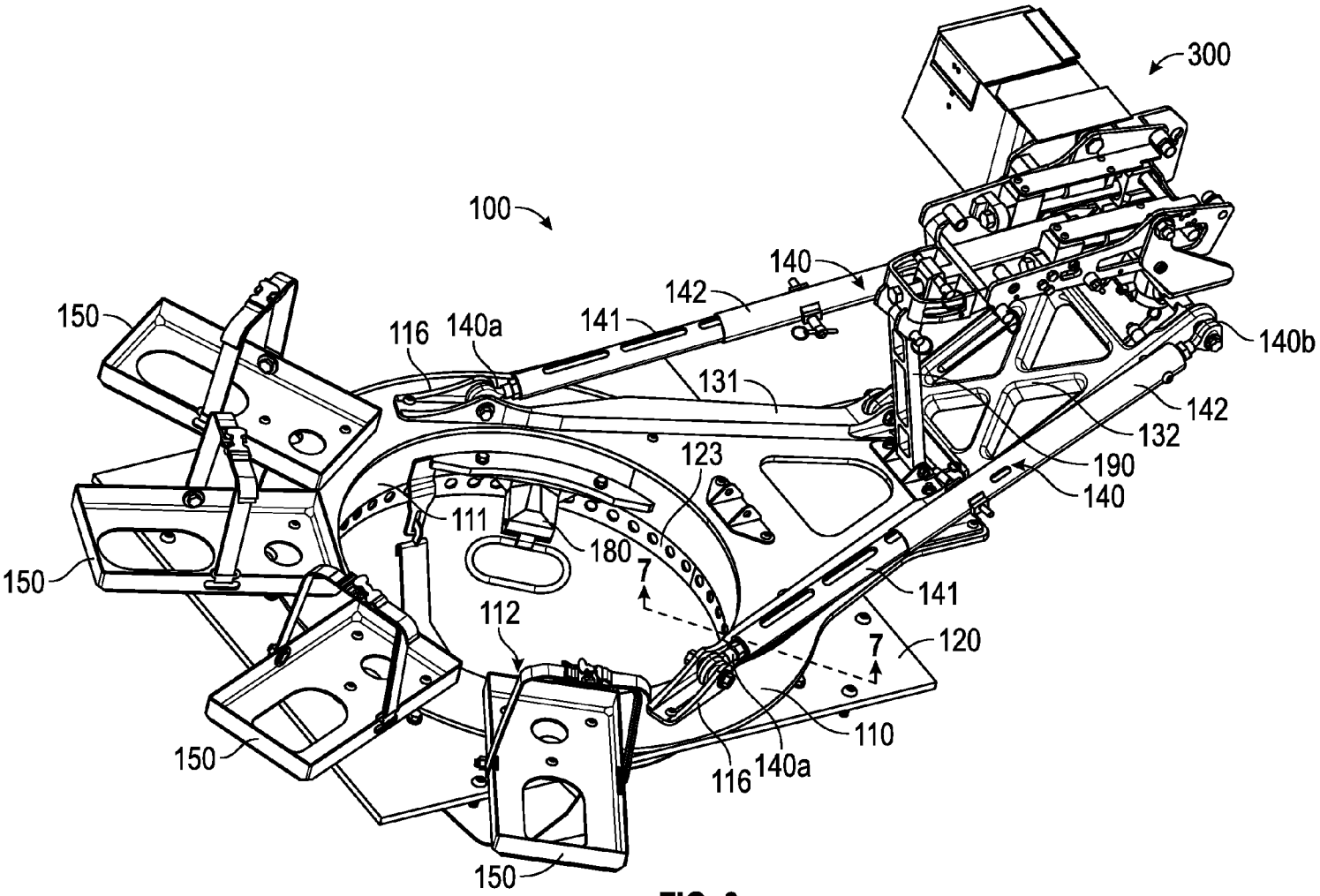
FIG. 3 is a perspective view of a turret assembly, according to an exemplary embodiment.

According to the exemplary embodiment shown in FIGS. 2A-3, the turret assembly 100 is movable between a storage position, as shown in FIG. 2A, and in an operating position, as shown in FIG. 2B. In the storage position as shown in FIG. 2A, the turret assembly 100 has an overall height of less than about 4 inches relative to a mounting plane such that a vehicle can be easily transported via cargo airplane, transport truck, or other suitable transport vehicle without having to remove or disassemble the turret assembly 100.

Figure 6:
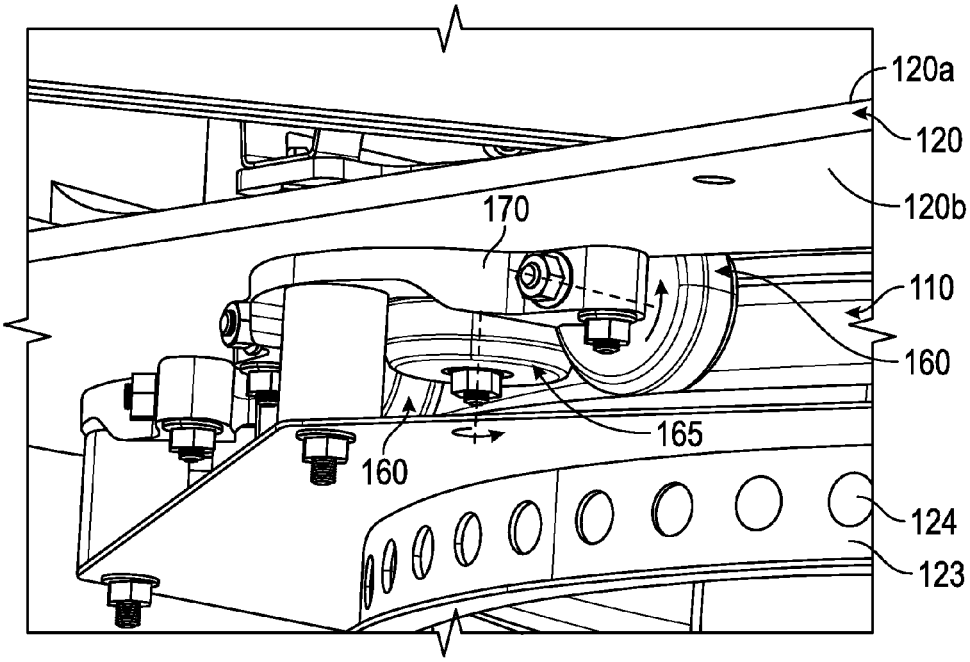
FIG. 6 is a side perspective view of a turret assembly, according to an exemplary embodiment.
Figure 7:
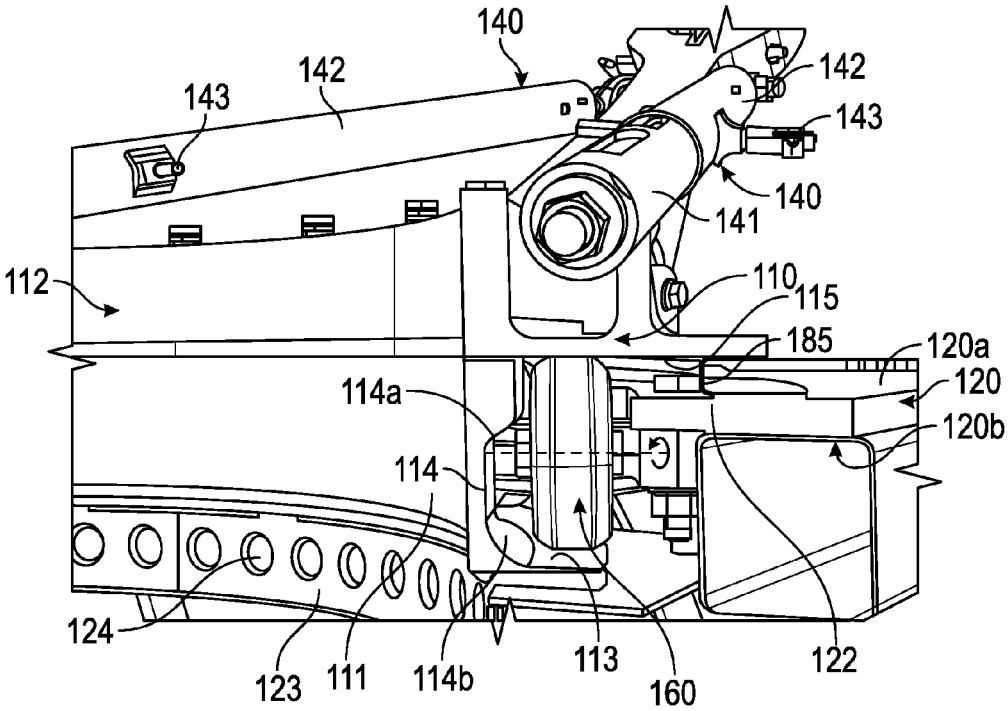
FIG. 7 is a cross section view of the turret assembly of FIG. 3, according to an exemplary embodiment.
Figure 8A:
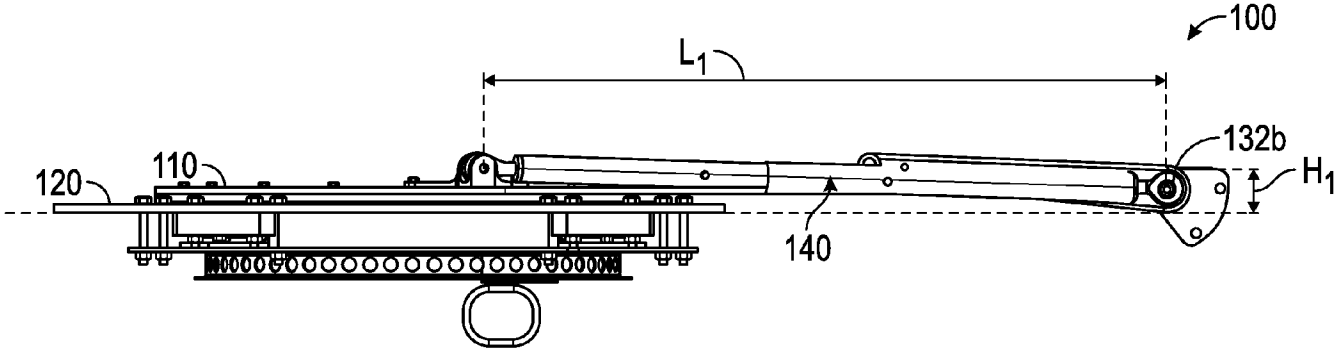
FIGS. 8A-8C illustrate a turret assembly configured in various positions, according to an exemplary embodiment.
Figure 8B:
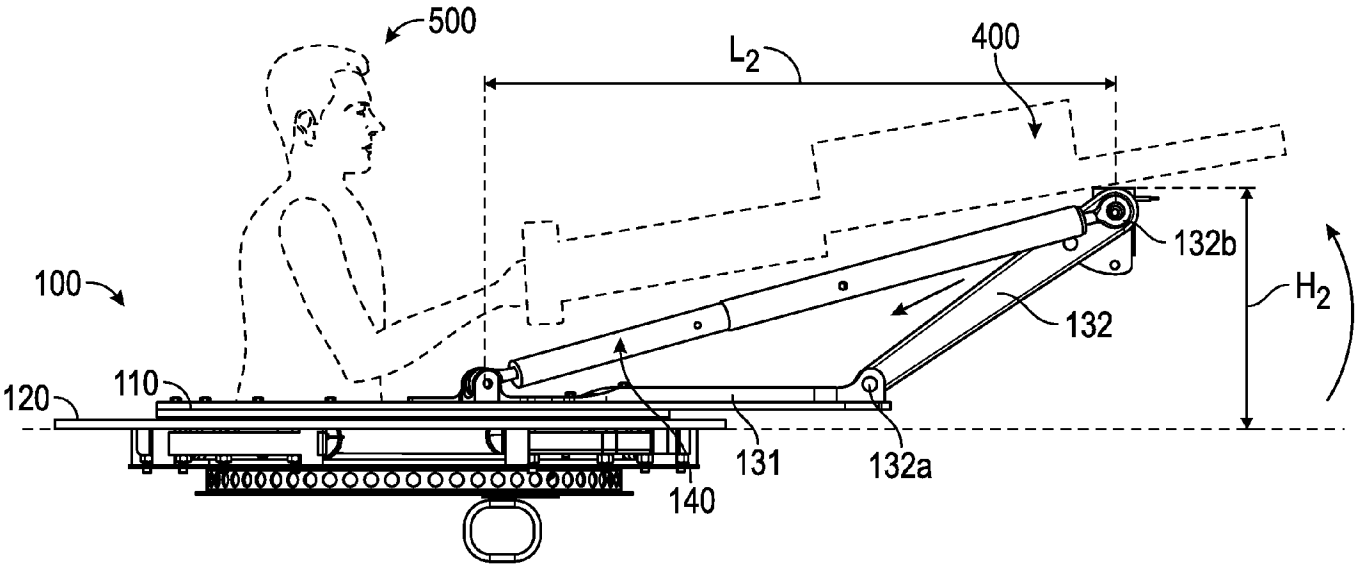
Figure 8C:
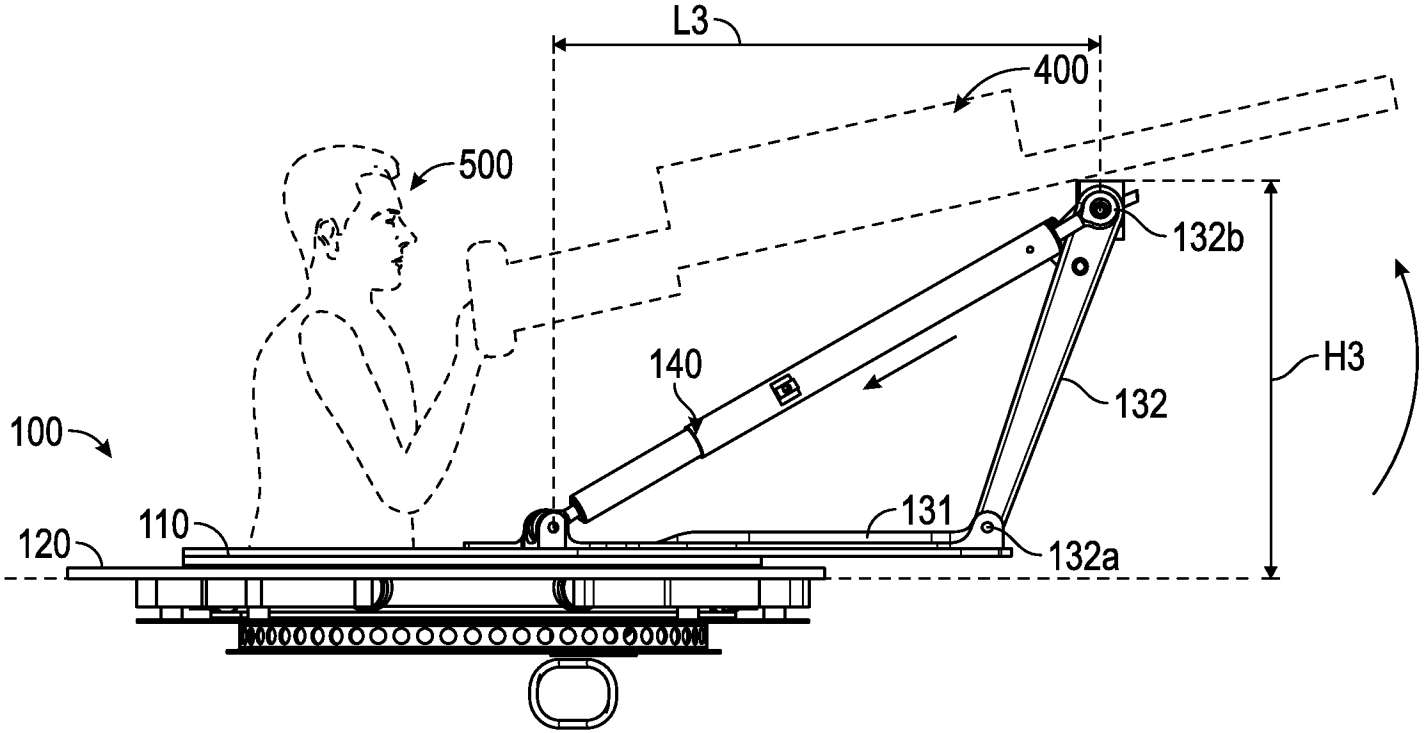

According to the exemplary embodiment shown in FIGS. 3-8C, turret assembly 100 includes a turret ring, shown as ring 110, that is rotatably engaged with (e.g., in rolling engagement with, etc.) a mounting plate 120, shown as mounting plate 120. According to an exemplary embodiment, ring 110 includes a first arm, shown as first arm 131. As shown in FIG. 3, the turret assembly 100 includes a second arm, shown as second arm 132, that is configured to be selectively pivoted or otherwise adjusted and locked at a desired operating position, such as the operating position shown in FIG. 2B. As shown in FIGS. 8A-8C, the second arm 132 includes a free end 132*b* configured to receive a weapon, such as a gun. The second arm 132 is configured to be pivoted or otherwise adjusted between a plurality of different operating positions to allow different users having different biological traits, such as different heights or weights, to access the weapon mounted at the free end 132*b* of the second arm 132.

Figure 4:
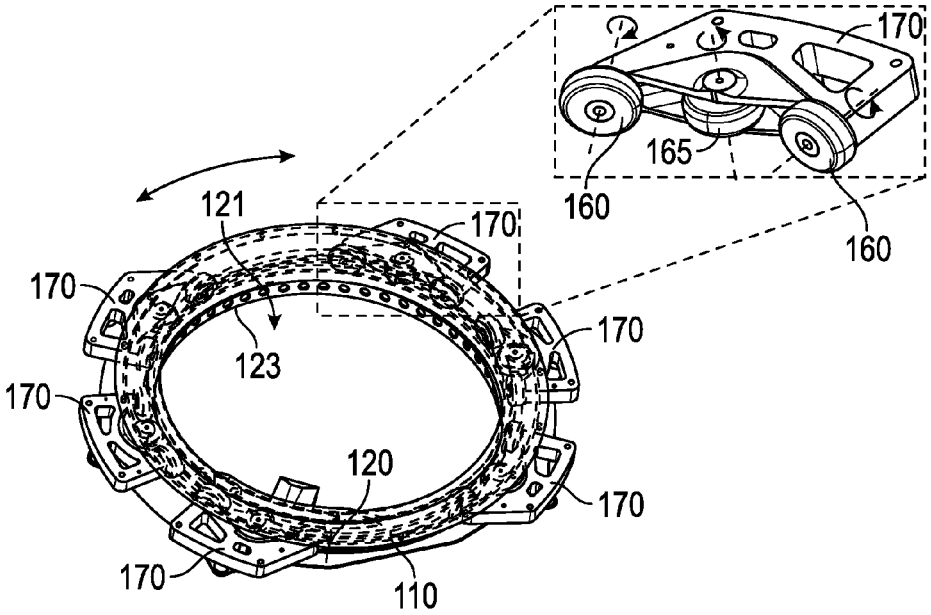
FIG. 4 is a perspective view of a turret ring rotatably coupled to a mounting plate, according to an exemplary embodiment.

According to the exemplary embodiment shown in FIGS. 3-4 and 6-7, mounting plate 120 is configured to couple (e.g., mount, attach, etc.) turret assembly 100 to a vehicle, such as the roof of vehicle 200 shown in FIG. 1. Mounting plate 120 is generally planar and includes an upper surface 120*a* and a lower surface 120*b*. Mounting plate 120 includes a plurality of apertures (e.g., openings, holes, etc.) configured to receive fasteners (e.g., bolts, screws, etc.) for coupling turret assembly 100 to the roof of a vehicle (e.g., a roof of body 220, etc.). As shown in FIGS. 4 and 7, mounting plate 120 further includes an opening 121 defined by an inner edge 122. The opening 121 of mounting plate 120 has a diameter sufficient to receive at least a portion of the ring 110 when ring 110 is rotatably engaged (e.g., in rolling engagement with, etc.) with mounting plate 120. The opening 121 has a diameter sufficient to permit the ingress or egress of a user but smaller than the width of the vehicle. According to an exemplary embodiment, mounting plate 120 includes a lower member having an inner ring 123 that defines a plurality of apertures 124. As shown in FIGS. 3-4 and 7, each of the plurality of apertures 124 is configured to receive a locking pin 180 to set a rotational position of the ring 110 relative to the mounting plate 120. According to an exemplary embodiment, the locking pin 180 is coupled to the ring 110 and is configured to be selectively engaged with and disengaged from the inner ring 123.

As shown in the cross-section view of FIG. 7, ring 110 includes an inner surface 111 defining an opening 112 configured to facilitate ingress or egress of a user from a vehicle. According to various exemplary embodiments, ring 110 is a typical gun ring used in a military vehicle, such as a JLTV. Ring 110 includes a side surface 114 disposed along a periphery (e.g., circumference, etc.) of ring 110. Side surface 114 is generally upright and includes upper transition 114*a* and lower transition 114*b*. Side surface 114, upper transition 114*a*, and lower transition 114*b* collectively define a channel that is configured to engage (e.g., contact, receive, etc.) a plurality of horizontally disposed bearing wheels. Side surface 114 transitions to a lower surface 113 at lower transition 114*b* and to an upper surface 115 at upper transition 114*a*. Upper surface 115 is generally planar and is disposed along a periphery (e.g., circumference, etc.) of ring 110. Upper surface 115 is configured to engage a plurality of vertically disposed bearing wheels. As shown in FIG. 7, upper surface 115 is defined by an upper portion of ring 110 and lower surface 113 is defined by a lower portion of ring 110. According to other exemplary embodiments, upper surface 115 and lower surface 113 may be defined by separate members coupled together to form ring 110.

According to an exemplary embodiment, lower surface 113 is configured to prevent ring 110 from articulating (e.g., teetering, etc.) in an upright direction when weight is applied to the turret assembly 100, such as when a weapon is mounted to second arm 132. For example, when a weapon is mounted to the free end 132*b* of second arm 132, the ring 110 will have a tendency to teeter due to at least one of the weight of the weapon and the weight of the user. A rear portion of the ring 110 located opposite the second arm 132 may tend to articulate in an upward direction and a front portion of the ring 110 located near the second arm 132 may tend to articulate in a downward direction. The lower surface 113 is configured to engage one or more of a plurality of vertically disposed bearing wheels to prevent or impede the upward movement of ring 110 at the rear portion of the ring 110.

According to an exemplary embodiment shown in FIGS. 4 and 6-7, ring 110 is rotatably engaged (e.g., in rolling engagement, etc.) with mounting plate 120 via a plurality of vertically disposed bearing wheels 160 and a plurality of horizontally disposed bearing wheels 165. Ring 110 is configured to rotate relative to mounting plate 120 via the plurality of vertically disposed bearing wheels 160 and the plurality of horizontally disposed bearing wheels 165. Each of the plurality of vertically disposed bearing wheels 160 and the plurality of horizontally disposed bearing wheels 165 is coupled to mounting plate 120 with support blocks, shown as support blocks 170. As shown in FIGS. 4 and 6-7, each of the vertically disposed bearing wheels 160 is oriented in a substantially upright (e.g., vertical, etc.) position and is configured to rotate about a substantially horizontal axis. According to an exemplary embodiment, each support block 170 includes a pair of vertically disposed bearing wheels 160 rotatably coupled thereto. The pair of vertically disposed bearing wheels 160 are oriented on support block 170 to reflect a peripheral edge (e.g., circumferential, etc.) of ring 110 such that at least a portion of the pair of vertically disposed bearing wheels 160 engages the upper surface 115 of ring 110 when ring 110 is rotatably engaged with mounting plate 120. Each of the horizontally disposed bearing wheels 165 is oriented substantially horizontally and is configured to rotate about a substantially vertical axis. According to an exemplary embodiment, each support block 170 includes a horizontally disposed bearing wheel 165 rotatably coupled between the pair of vertically disposed bearing wheels 160. The horizontally disposed bearing wheel 165 is positioned on support block 170 such that at least a portion of the horizontally disposed bearing wheel 165 engages the side surface 114 (e.g., channel, etc.) of ring 110 when ring 110 is rotatably engaged (e.g., in rolling engagement, etc.) with mounting plate 120. According to other exemplary embodiments, each support block 170 includes a plurality of horizontally disposed bearing wheels 165 coupled thereto.

According to an exemplary embodiment, mounting plate 120 includes a seal 185 coupled to upper surface 120*a*. Seal 185 may prevent water or debris (e.g., sand, etc.) from entering the plurality of vertically disposed bearing wheels 160 and the plurality of horizontally disposed bearing wheels 165. As shown in FIG. 7, the seal is disposed between the mounting plate 120 and an upper portion of the ring 110. In one embodiment, the seal 185 engages upper surface 115. The seal 185 may have an "L" shape and substantially surround the opening 121 of mounting plate 120.

As shown in FIGS. 6-7, the support block 170 may coupled to a surface of the mounting plate 120, such as upper surface 120*a* or lower surface 120*b*. In one embodiment, at least a portion of the plurality of vertically disposed bearing wheels 160 and at least a portion of the horizontally disposed bearing wheels 165 is positioned below the mounting plate 120. This configuration, advantageously, reduces the overall height of the turret assembly 100 to facilitate transporting a vehicle equipped with the turret assembly 100. Each of the support blocks 170 is coupled to the mounting plate 120 at various angular positions relative to (e.g., concentric with, etc.) a peripheral edge (e.g., circumferential, etc.) of mounting plate 120, such as inner edge 122. According to the exemplary embodiment shown in FIG. 4, six support blocks 170 are coupled to mounting plate 120 at various angular positions about the opening 121 of mounting plate 120. According to other exemplary embodiments, more or fewer support blocks 170 may be included in turret assembly 100.

According to various exemplary embodiments, each of the plurality of vertically disposed bearing wheels 160 and the horizontally disposed bearing wheels 165 include an engagement portion. The engagement portion is manufactured from a polymeric material, according to an exemplary embodiment. The polymeric material may include plastic, rubber, or another material. The engagement portion may interface with ring 110 such that ring 110 can freely rotate relative to mounting plate 120. According to an exemplary embodiment, each of the plurality of vertically disposed bearing wheels 160 and the plurality of horizontally disposed bearing wheels 165 has a diameter of between about 2 inches and about 3 inches. According to other exemplary embodiments, the plurality of vertically disposed bearing wheels 160 and the plurality of horizontally disposed bearing wheels 165 may have different diameters suitable for rotatably engaging ring 110.

According to the exemplary embodiment shown in FIG. 3, first arm 131 extends radially outward relative to a central axis of the ring (e.g., an axis orthogonal to a plane in which ring 110 extends and passing through a center of ring 110, etc.). In one embodiment, first arm 131 extends outward from an outer edge (e.g., periphery, etc.) of ring 110. As shown in FIG. 3, a proximal end of second arm 132 is coupled to a distal end of the first arm 131. The second arm 132 includes a pivot end 132*a* opposite the free end 132*b*, according to an exemplary embodiment. The second arm 132 may be pivotally coupled to the first arm 131 at the pivot end 132*a*. The second arm 132 is configured to be selectively moved (e.g., pivoted, articulated, rotated, adjusted, etc.) relative to the mounting plate 120 about the pivot end 132*a*. According to an exemplary embodiment, the free end 132*b* includes a weapons mount (e.g., adapter, etc.) configured to receive a military weapon, such as a gun (e.g., 50 caliber gun, etc.), mounting hardware, other weapons adapters, or other types of military weapons.

As shown in FIGS. 3 and 7, the free end 132*b* of second arm 132 is pivotally coupled to ring 110 via a pair of telescoping members 140. In one embodiment, each of the telescoping members 140 includes an inner member 141 and an outer member 142 substantially surrounding the inner member 141. The inner member 141 and the outer member 142 are configured to move (e.g., slide, translate, etc.) relative to each other along a linear direction to thereby adjust an overall length of the telescoping member 140. Each of the telescoping members 140 includes a first end 140*a* and a second end 140*b*. The first end 140*a* is pivotally coupled to the ring 110 at a mounting flange 116. According to the exemplary embodiment shown in FIG. 3, the mounting flange is located on a top surface of the ring 110, positioned outside of the opening 112. In the embodiment shown in FIG. 3, ring 110 includes a pair of mounting flanges 116 located opposite each other on the top surface of the ring 110. Each of the mounting flanges 116 may be configured to receive the first end 140*a* of a telescoping member 140. The second end 140*b* of each telescoping member 140 may be pivotally coupled to the second arm 132. As shown in FIG. 3, the second end 140*b* of each of the telescoping members 140 is pivotally coupled to an opposite side of the second arm 132. Each of the telescoping members 140 is configured to extend or retract when second arm 132 is selectively pivoted (e.g., articulated, adjusted, pivoted, etc.).

Referring next to FIGS. 8A-8C, turret assembly 100 is shown in various operating positions. The turret assembly 100 is shown in a storage position in FIG. 8A and at two different operating positions in FIGS. 8B-8C respectively. According to an exemplary embodiment, turret assembly 100 is configured to be selectively adjusted (e.g., pivoted, etc.) by a user between the storage position of FIG. 8A and a plurality of different operating positions, such as the operating positions of FIGS. 8B-8C. As shown in the storage position of FIG. 8A, the second arm 132 is fully extended such that a first height $H_1$ of the turret assembly 100 is less than about 4 inches relative to a mounting plane, and each of the telescoping members 140 is extended to a first length $L_1$. In the storage position, a vehicle having turret assembly 100 can easily fit within a shipping container or vessel without the need to disassemble or remove turret assembly 100.

Referring now to FIG. 8B, turret assembly 100 is shown in a first operating orientation suitable for a user 500 to access a weapon 400 coupled to the free end 132*b* of second arm 132. The second arm 132 is pivoted upward such that the turret assembly 100 has a second height $H_2$ that is greater than the first height $H_1$. Each of the telescoping members 140 is retracted to a second length $L_2$ that is less than the first length $L_1$. In this operating position, a user 500 that is shorter (e.g., a female user, etc.) can easily and comfortably access the weapon 400 mounted at the free end 132*b* of the second arm 132.

Referring now to FIG. 8C, turret assembly 100 is shown in a second operating orientation. The second arm 132 is pivoted further upward such that the turret assembly 100 has a third height $H_3$ that is greater than the first and second heights $H_1$ and $H_2$. Each of the telescoping members 140 is retracted to a third length $L_3$ that is less than the first and second lengths $L_1$ and $L_2$. In this operating position, a user 500 that is taller (e.g., a male user, etc.) can easily and comfortably access a weapon 400 mounted at the free end 132*b* of the second arm 132.

Figure 5:
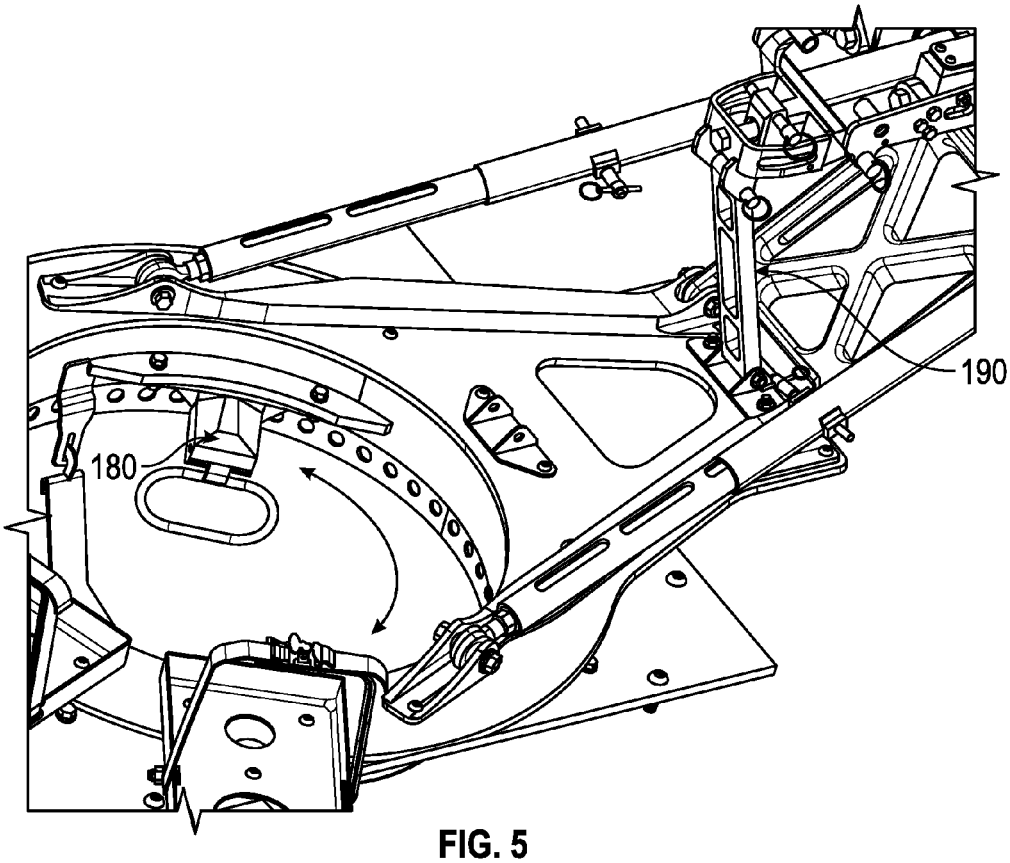
FIG. 5 is another perspective view of the turret assembly of FIG. 3, according to an exemplary embodiment.

According to the exemplary embodiment shown in FIGS. 3 and 5, turret assembly 100 includes a locking member 190 configured to lock a relative position of a weapon (e.g., weapon 400 of FIGS. 8B-8C, etc.) mounted at the free end 132*b* of the second arm 132. The locking member 190 is pivotally coupled to the first arm 131 at a first end and is pivotally coupled to a weapon at a second end. The locking member 190 maintains a position of the weapon relative to a user such that the user can easily and comfortably access the weapon.

According to an exemplary embodiment, second arm 132 is configured to be selectively pivoted and locked at a desired position by a user via a locking mechanism 143 located on each of the telescoping members 140. As shown in FIG. 7, each locking mechanism 143 is positioned on outer member 142 of each telescoping member 140. Each locking mechanism 143 is configured to be selectively locked and released by a user to adjust a length of each telescoping member 140, thereby adjusting a relative position or height of the second arm 132. According to an exemplary embodiment, each telescoping member 140 includes a plurality of locking positions defined by apertures disposed along at least one of outer member 142 and inner member 141. The locking mechanism 143 may be configured to engage a selected aperture of at least one of the outer member 142 and the inner member 141 to set an overall length of each telescoping member 140. In one embodiment, the locking mechanism 143 includes a pin configured to be manually engaged with and released from a selected aperture of at least one of outer member 142 and inner member 141. The locking mechanism 143 may include a spring loaded pin, a cotter key, a set screw, or other locking mechanism suitable for selectively adjusting and setting an overall length of each of the telescoping members 140.

In one embodiment, telescoping members 140 include a resilient member (e.g., coil spring, gas spring, etc.). The resilient member may be disposed within the inner member 141 and the outer member 142 of telescoping member 140. In one embodiment, the resilient member applies a force that biases telescoping member 140 into an extended configuration. By way of example, the force may be applied in a direction that extends along the length of the telescoping member 140. The resilient member may facilitate adjustment of the turret assembly 100 between the various operating orientations. By way of example, a load (e.g., the weapon 400 shown in FIGS. 8B-8C, etc.) may be coupled to the free end 132*b* of the second arm 132, and the force imparted by the resilient member may offset at least a portion of the load (e.g., to facilitate raising and lowering a weapon coupled to the free end 132*b* of the second arm 132, etc.). According to an exemplary embodiment, the resilient member is tuned such that the applied force offsets a particular load. In one embodiment, the resilient member may be preset (e.g., with an initial spring characteristic and initial length, with an initial pressure, etc.) based on the weight of a particular weapon to be mounted at the free end 132*b* of the second arm 132. In another embodiment, the telescoping member 140 includes an adjuster configured to facilitate varying the force imparted by the resilient member. By way of example, the adjuster may include a plate that is coupled to the resilient member (e.g., an end of a coil spring, etc.) and adjustably coupled (e.g., with a threaded connection, etc.) to at least one of the inner member 141 and the outer member 142 of the telescoping member 140. By way of another example, the adjuster may include a port, valve, or other system that is used to change a pressure, volume, temperature, or other feature of a gas associated with the resilient member. According to an exemplary embodiment, the turret assembly 100 includes a locking mechanism (e.g., the locking mechanism 143, etc.) positioned to limit relative movement between the inner member 141 and the outer member 142 of the telescoping member 140. A user may selectively engage the locking mechanism to deactivate the resilient member (e.g., while firing a weapon mounted at the free end 132*b* of the second arm 132, etc.).

In another embodiment, telescoping members 140 include a damper. By way of example, at least one of the telescoping members 140 may be a strut. According to an exemplary embodiment, the damper includes an orifice plate disposed within at least one of the inner member 141 and the outer member 142, and relative movement between the inner member 141 and the outer member 142 forces a fluid flow through the orifice plate to produce damping forces. The damper may facilitate adjustment of turret assembly 100 between the various operating orientations. By way of example, when a load (e.g., the weapon 400 shown in FIGS. 8B-8C, etc.) is coupled to the free end 132*b* of the second arm 132, each of the telescoping members 140 may experience a linear force. If the locking mechanism 143 is released while the load is disposed at the free end 132*b*, the telescoping members 140 may rapidly extend due to the linear force. The damper may absorb (e.g., dissipate, resist, counter, etc.) the linear force resulting from the load disposed at the free end 132*b* and thereby assists a user with adjusting the telescoping members 140. The damper may, in the alternative or in addition, absorb (e.g., dissipate, resist, counter, etc.) recoil forces imparted on telescoping members 140 by a firing weapon. In still other embodiments, telescoping members 140 include a resilient member and a damper. The resilient member may be tuned to support the load applied at the free end 132*b* of the second arm 132 while the damper may absorb forces in response to sudden extension or retraction of telescoping members 140 (e.g., due to sudden lifting or lowering of weapon 400 as the vehicle traverses uneven terrain, due to recoil forces imparted by a firing weapon, etc.).

According to alternative embodiments, at least one of the telescoping members 140 is configured to be actuated (e.g., driven, adjusted, etc.) such that a user may remotely articulate the second arm 132. By way of example, at least one of the telescoping members 140 may be in fluid communication with a pump or valve configured to provide a fluid flow to a cylinder that adjusts a length of the telescoping member 140. A user may remotely adjust the length of the telescoping member 140 by selectively operating the pump or valve from a remote location, such as inside a vehicle. According to other exemplary embodiments, at least one telescoping member 140 may be coupled to a motor or other suitable drive mechanism to remotely adjust a length of each telescoping member 140. In this manner, a user may remotely set an operating position of turret assembly 100.

According to the exemplary embodiment shown in FIG. 3, turret assembly 100 includes a plurality of trays 150 coupled to an upper surface of ring 110. Each of the trays 150 is configured to receive a storage container, such as an ammunition box or other type of container. As shown in FIG. 3, each of the plurality of trays 150 is arranged concentrically with the opening 112 of the ring 110. In one embodiment, each of the trays 150 is positioned toward a rear portion of the turret assembly 100 opposite the second arm 132. This configuration is advantageous in that when each of the plurality of trays 150 includes a storage container with equipment stored therein, the plurality of trays 150 counterbalances the weight of a weapon mounted on the second arm 132, thereby enabling the ring 110 to rotate more freely (e.g., unimpeded, etc.) relative to the mounting plate 120. In addition, because the plurality of trays are coupled to the ring 110, the plurality of trays 150 will rotate with the ring 110 relative to the mounting plate 120. This configuration provides a user better access to equipment stored on the trays 150 when the ring 110 is rotated to various rotational positions.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element (e.g., the plurality of vertically disposed bearing wheels 160 and the plurality of horizontally disposed bearing wheels 165, support block 170, ring 110, mounting plate 120, etc.) disclosed in one embodiment may be incorporated or utilized with any other embodiment disclosed herein.

What is claimed is:

1. A turret assembly configured to be coupled to a vehicle, the turret assembly comprising:

a mounting plate;

a plurality of vertically disposed bearing wheels coupled to the mounting plate;

a plurality of horizontally disposed bearing wheels coupled to the mounting plate; and a ring rotatably engaged with the mounting plate via the plurality of vertically disposed bearing wheels and the plurality of horizontally disposed bearing wheels, wherein the ring defines a side surface around a peripheral edge of the ring, the side surface including upper and lower transitions, wherein the side surface defines a channel positioned to engage the plurality of horizontally disposed bearing wheels, the ring further defining a planar lower surface positioned to selectively interfere with the plurality of vertically disposed bearing wheels to limit upward movement of the ring.

2. The turret assembly of claim 1, wherein at least a portion of each of the plurality of vertically disposed bearing wheels and a portion of each of the plurality of horizontally disposed bearing wheels is positioned below the mounting plate.

3. The turret assembly of claim 2, wherein the ring defines a planar upper surface positioned to engage the plurality of vertically disposed bearing wheels.

4. A turret assembly configured to be coupled to a vehicle, the turret assembly comprising:

a mounting plate;

a plurality of vertically disposed bearing wheels coupled to the mounting plate;

a plurality of horizontally disposed bearing wheels coupled to the mounting plate;

a ring rotatably engaged with the mounting plate via the plurality of vertically disposed bearing wheels and the plurality of horizontally disposed bearing wheels; and a lock mechanism configured to secure the ring thereby limiting rotational movement of the ring relative to the mounting plate, wherein the lock mechanism includes a pin, and wherein the mounting plate includes a lower ring defining a plurality of apertures configured to receive the pin thereby setting a rotational position of the ring relative to the mounting plate.

5. The turret assembly of claim 1, further comprising a support block coupled to the mounting plate, wherein the plurality of vertically disposed bearing wheels includes a first wheel coupled to the support block, and wherein the plurality of horizontally disposed bearing wheels includes a second wheel coupled to the support block.

6. The turret assembly of claim 5, further comprising a plurality of support blocks arranged concentrically with an opening of the mounting plate.

7. The turret assembly of claim 4, wherein at least a portion of each of the plurality of vertically disposed bearing wheels and a portion of each of the plurality of horizontally disposed bearing wheels is positioned below the mounting plate.

8. The turret assembly of claim 7, wherein the ring defines a planar upper surface positioned to engage the plurality of vertically disposed bearing wheels.

9. The turret assembly of claim 4, further comprising a support block coupled to the mounting plate, wherein the plurality of vertically disposed bearing wheels includes a first wheel coupled to the support block, and wherein the plurality of horizontally disposed bearing wheels includes a second wheel coupled to the support block.

10. The turret assembly of claim 9, further comprising a plurality of support blocks arranged concentrically with an opening of the mounting plate.

11. A turret assembly configured to be coupled to a vehicle, the turret assembly comprising:

a mounting plate;

a plurality of vertically disposed bearing wheels coupled to the mounting plate;

a plurality of horizontally disposed bearing wheels coupled to the mounting plate, wherein at least one of the plurality of vertically disposed bearing wheels and the plurality of horizontally disposed bearing wheels includes a wheel having an engagement portion, wherein the engagement portion comprises a polymeric material; and a ring rotatably engaged with the mounting plate via the plurality of vertically disposed bearing wheels and the plurality of horizontally disposed bearing wheels.

12. The turret assembly of claim 11, wherein at least a portion of each of the plurality of vertically disposed bearing wheels and a portion of each of the plurality of horizontally disposed bearing wheels is positioned below the mounting plate.

13. The turret assembly of claim 12, wherein the ring defines a planar upper surface positioned to engage the plurality of vertically disposed bearing wheels.

14. The turret assembly of claim 11, further comprising a support block coupled to the mounting plate, wherein the plurality of vertically disposed bearing wheels includes a first wheel coupled to the support block, and wherein the plurality of horizontally disposed bearing wheels includes a second wheel coupled to the support block.

15. The turret assembly of claim 14, further comprising a plurality of support blocks arranged concentrically with an opening of the mounting plate.

* * * * *